US008032959B2

(12) United States Patent
Rowson et al.

(10) Patent No.: US 8,032,959 B2
(45) Date of Patent: Oct. 11, 2011

(54) BED SHEET ATTACHMENT SYSTEM AND METHODS

(75) Inventors: Deborah S. Rowson, Alpharetta, GA (US); Geoffrey R. Rowson, Alpharetta, GA (US)

(73) Assignee: Lazy Linens, Inc., Alpharetta, GA (US)

( * ) Notice: Subject to any disclaimer, the term of this patent is extended or adjusted under 35 U.S.C. 154(b) by 128 days.

(21) Appl. No.: 11/805,587

(22) Filed: May 23, 2007

(65) Prior Publication Data

US 2008/0289104 A1 Nov. 27, 2008

(51) Int. Cl.
*A47G 9/00* (2006.01)

(52) U.S. Cl. ..... 5/496; 5/488; 5/495; 5/498; 5/502

(58) Field of Classification Search ..... 5/485, 482, 5/486, 488, 495, 496, 497, 498, 499, 500, 5/502, 503.1
See application file for complete search history.

(56) References Cited

U.S. PATENT DOCUMENTS

| | | | | |
|---|---|---|---|---|
| 1,347,642 | A * | 7/1920 | McNatt | 5/502 |
| 2,763,875 | A | 9/1956 | Piontkowski | |
| 3,083,378 | A | 4/1963 | Pursell | |
| 3,308,490 | A * | 3/1967 | Cacioppo | 5/652 |
| 3,570,026 | A | 3/1971 | Allison | |
| 3,832,743 | A | 9/1974 | Smith | |
| 3,965,504 | A * | 6/1976 | Ainsworth | 5/485 |
| 4,129,909 | A * | 12/1978 | Riehl | 5/503.1 |
| 4,161,044 | A | 7/1979 | Bogle | |
| 4,241,466 | A * | 12/1980 | Mendyk | 5/497 |
| 4,384,380 | A | 5/1983 | Glaha et al. | |
| 4,389,744 | A * | 6/1983 | Monroe | 5/498 |
| 4,488,323 | A | 12/1984 | Colburn | |
| 4,549,323 | A * | 10/1985 | Brockhaus | 5/668 |
| 4,646,375 | A | 3/1987 | Parker | |
| 4,899,408 | A | 2/1990 | Illingworth | |
| 4,922,565 | A | 5/1990 | Blake | |
| 4,924,543 | A * | 5/1990 | Hoss et al. | 5/502 |

(Continued)

FOREIGN PATENT DOCUMENTS

GB 2079596 A * 1/1982

OTHER PUBLICATIONS http://www.masterpiecepetproducts.com/store/shopexd.asp?id=17 printed Jul. 9, 2008.

(Continued)

*Primary Examiner* — Thomas Beach
*Assistant Examiner* — Gilbert Lee
(74) *Attorney, Agent, or Firm* — Brinks Hofer Gilson & Lione

(57) ABSTRACT

The present invention provides a bed sheet attachment system that allows a user to quickly and easily change bed sheets. In one embodiment, the fitted sheet of a bed comprises an upper surface and at least one attachment member disposed on the upper surface. A quick-change sheet having upper and lower surfaces also is provided, wherein at least one attachment member is disposed on the lower surface of the quick-change sheet. In use, the attachment member of the quick-change sheet is configured to releasably mate with the attachment member of the fitted sheet, thereby facilitating the changing of the quick-change sheet. Further, at least one pocket member may be releasably coupled to the fitted sheet, thereby providing one or more storage locations in close proximity to the bed.

23 Claims, 7 Drawing Sheets

U.S. PATENT DOCUMENTS

| | | | | |
|---|---|---|---|---|
| 4,979,251 | A | 12/1990 | Lazar | |
| 5,003,655 | A | 4/1991 | Kafai | |
| 5,020,177 | A * | 6/1991 | Etherington | 5/496 |
| 5,042,099 | A | 8/1991 | Brenner et al. | |
| 5,070,561 | A * | 12/1991 | Keidser | 5/482 |
| 5,086,530 | A | 2/1992 | Blake | |
| 5,092,010 | A * | 3/1992 | Wong | 5/496 |
| 5,144,911 | A | 9/1992 | Moore et al. | |
| 5,208,926 | A | 5/1993 | Stackhouse | |
| 5,321,862 | A | 6/1994 | Campbell | |
| 5,566,411 | A | 10/1996 | Eiler | |
| 5,732,424 | A | 3/1998 | Bond | |
| 5,758,972 | A | 6/1998 | Mack et al. | |
| 5,884,349 | A | 3/1999 | Gretsinger | |
| 6,098,219 | A | 8/2000 | Milber | |
| 6,122,781 | A | 9/2000 | Stephenson | |
| 6,122,783 | A | 9/2000 | Herndon et al. | |
| 6,178,574 | B1 | 1/2001 | Stromatt et al. | |
| 6,237,171 | B1 | 5/2001 | Allen | |
| 6,243,895 | B1 | 6/2001 | Amin | |
| 6,292,963 | B1 | 9/2001 | Couture | |
| 6,490,741 | B1 * | 12/2002 | Wheeler | 5/494 |
| D471,049 | S | 3/2003 | Dale | |
| 6,651,278 | B2 | 11/2003 | Ghanem | |
| 6,739,002 | B1 | 5/2004 | Pannu | |
| 6,757,923 | B2 | 7/2004 | Sopher et al. | |
| 6,823,543 | B2 | 11/2004 | Diak/Ghanem | |
| 6,848,132 | B1 * | 2/2005 | Dale | 5/503.1 |
| 6,854,139 | B2 | 2/2005 | Lamy | |
| 6,859,962 | B2 * | 3/2005 | Ghanem | 5/499 |
| 6,874,180 | B2 * | 4/2005 | Liao | 5/486 |
| 6,886,197 | B1 | 5/2005 | Madigan | |
| 7,047,580 | B2 | 5/2006 | Finn | |
| 7,131,152 | B2 | 11/2006 | Wootten, Jr. et al. | |
| D546,613 | S | 7/2007 | OConnor | |
| 7,243,385 | B2 | 7/2007 | Lampkins | |
| 7,370,377 | B2 * | 5/2008 | Landry | 5/494 |
| 7,487,560 | B2 | 2/2009 | McGrath et al. | |
| 2002/0018601 | A1 * | 2/2002 | Nelson | 383/7 |
| 2003/0070232 | A1 * | 4/2003 | Diak/Ghanem | 5/496 |
| 2003/0163870 | A1 | 9/2003 | Porter et al. | |
| 2003/0177579 | A1 * | 9/2003 | Diak/Ghanem | 5/499 |
| 2004/0016055 | A1 | 1/2004 | Lamy | |
| 2004/0117909 | A1 * | 6/2004 | Liao | 5/482 |
| 2004/0139552 | A1 * | 7/2004 | Walters, Jr. | 5/737 |
| 2004/0261175 | A1 * | 12/2004 | May | 5/503.1 |
| 2007/0000053 | A1 * | 1/2007 | Yang | 5/493 |
| 2007/0214569 | A1 | 9/2007 | Miller | |
| 2007/0271699 | A1 | 11/2007 | Sacchetti | |

OTHER PUBLICATIONS

International Search Report and Written Opinion for PCT/US2008/064298 Mailed Sep. 11, 2008.

International Preliminary Report on Patentability for PCT/US2008/064298 Mailed Dec. 3, 2009.

* cited by examiner

BED SHEET ATTACHMENT SYSTEM AND METHODS

BACKGROUND

The present invention relates generally to apparatus and methods for changing bed sheets and accessories that may used in a bedding system, and more particularly, to a system of bed sheets and accessories that may be assembled and changed in a relatively fast and convenient manner.

Conventional bedding systems typically employ a frame and mattress arrangement. The mattress is disposed on the frame, and a fitted sheet may be disposed over the mattress. Typically, the fitted sheet comprises one or more elastic bands that must be placed over the four sides of the mattress, then positioned underneath the mattress to secure the fitted sheet. Subsequently, a top sheet may be disposed over the fitted sheet. One or more comforters, quilts, blankets or other coverings may be disposed over the top sheet, thereby completing the bedding system.

One drawback associated with such conventional bedding systems is that it may be difficult and/or time consuming to change the sheets. For example, in the system described above, a user may sleep directly on the fitted sheet, i.e., between the fitted sheet and the top sheet. If the fitted sheet becomes dirty or soiled, then typically the user must remove the fitted sheet by pulling the elastic bands of the fitted sheet over the four corners of the mattress. If a bed is located adjacent to a wall, it may become difficult or time consuming to pull the bed away from the wall in order to pull the fitted sheet over the mattress. Similarly, when making the bed, it may be difficult and/or time consuming to pull the bed away from the wall, secure the fitted sheet over the mattress, and subsequently push the bed against the wall. In short, many users may experience difficulties in removing and attaching a fitted sheet over a mattress.

Problematically, many users may need to change the fitted sheet relatively often. For example, infants may frequently soil bed sheets, thereby requiring frequent changing of the sheets. Similarly, elderly persons may soil the sheets, and may have difficulty removing and attaching the fitted sheets. Further, college-aged students and other individuals may tend to change sheets less frequently, in part due to the difficulty of removing a fitted sheet that may be pressed against a wall in relatively small dorm room. Finally, menopausal women and other individuals may have frequent night sweats, thereby necessitating frequent changing of the bed sheets.

In view of the foregoing, there is a need for an easy-to-use bed sheet system that employs a fast, easy-to-use attachment system to facilitate removal of a soiled sheet and attachment of a clean sheet.

SUMMARY

The present invention provides a bed sheet attachment system that allows a user to quickly and easily change bed sheets. In one embodiment, the fitted sheet of a bed comprises an upper surface and at least one attachment member disposed on the upper surface. A quick-change sheet having upper and lower surfaces also is provided, wherein at least one attachment member is disposed on the lower surface of the quick-change sheet. In use, the attachment member of the quick-change sheet is configured to releasably mate with the attachment member of the fitted sheet, thereby facilitating the changing of the quick-change sheet.

In a preferred embodiment, a mattress pad may be disposed on the upper surface of the fitted sheet, and the attachment members of the fitted sheet may be disposed at one or more locations spaced apart from the mattress pad. This allows a user to comfortably rest on a substantially smooth area of the fitted sheet overlaying the mattress pad, while reducing or eliminating potential contact between the user and the attachment members.

The quick-change sheet may cover substantially the entire area of the fitted sheet. Alternatively, the quick-change sheet may be adapted to overlay only a portion of the upper surface of the fitted sheet, such that a substantial remaining portion of the upper surface of the fitted sheet is not covered by the quick-change sheet. In the latter embodiment, a first portion of the bed may be changed without disturbing a remaining portion of the bed.

If desired, at least one pocket member may be releasably coupled to the fitted sheet, thereby providing one or more storage locations in close proximity to the bed. Preferably, the pocket member comprises at least one attachment member configured to releasably mate with the attachment member of the fitted sheet. When attached, a portion of the pocket member may be disposed over a side surface of the fitted sheet, and readily accessible to a user, even when the quick-change sheet is coupled to the fitted sheet. Multiple pocket members may be coupled to various attachment members disposed at one or more locations around the perimeter of the bed.

Further, one or more top sheets, comforters, quilts, blankets and/or other coverings may be used in conjunction with the bedding system. In one alternative embodiment, at least a portion of the bottom end of the quick-change sheet may be attached to the bottom end of a top sheet. In use, when the quick-change sheet is coupled to the fitted sheet, the top sheet may be disposed to substantially cover the upper surface of the quick-change sheet, thereby making the bed.

Other systems, methods, features and advantages of the invention will be, or will become, apparent to one with skill in the art upon examination of the following figures and detailed description. It is intended that all such additional systems, methods, features and advantages be within the scope of the invention, and be encompassed by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
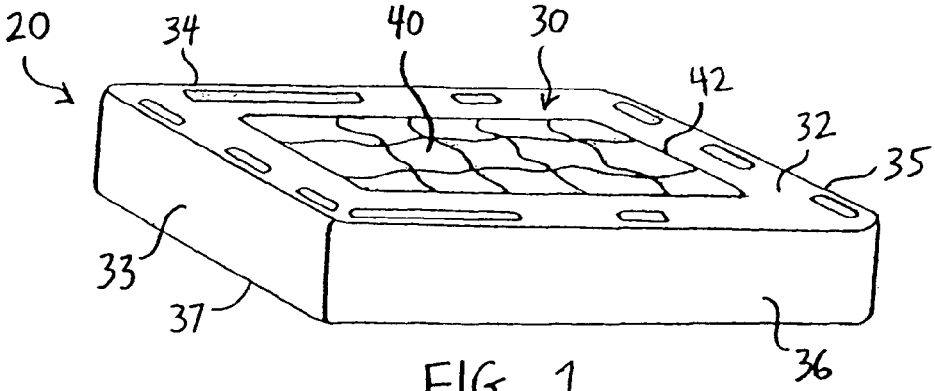
FIG. 1 is a front perspective view of a fitted sheet and mattress pad according to a first embodiment of the present invention.
Figure 2:
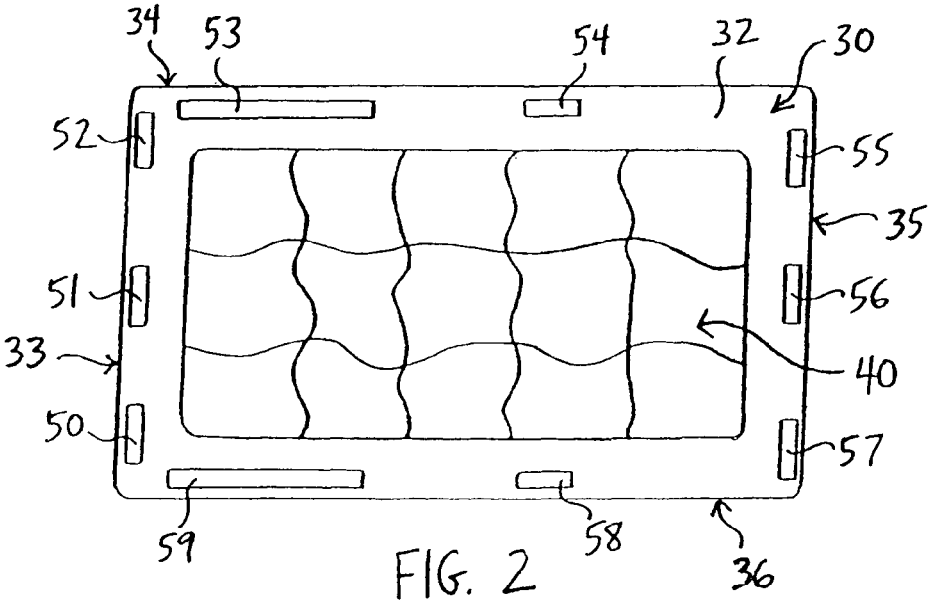
FIG. 2 is a top view of the fitted sheet and mattress pad of FIG. 1.
Figure 3:
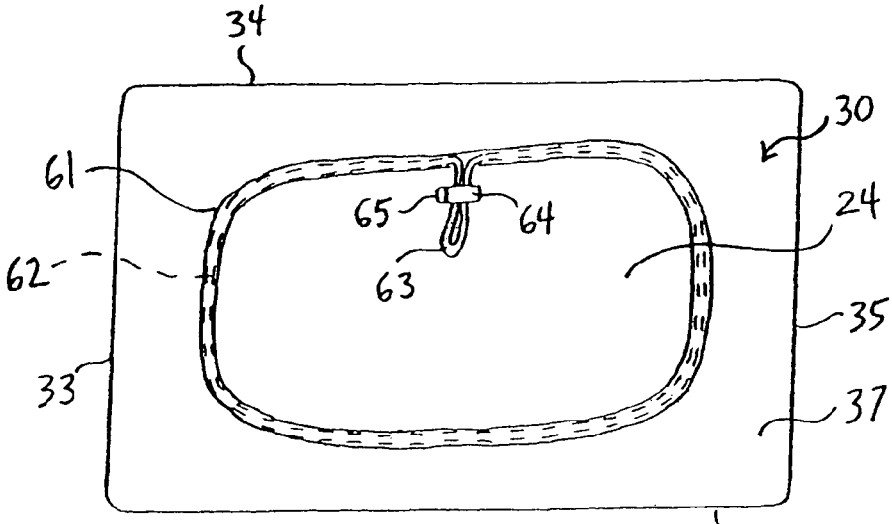
FIG. 3 is a bottom view of the fitted sheet of FIGS. 1-2 when disposed over a mattress.

Referring now to FIGS. 1-3, a first embodiment of a fitted sheet and mattress pad that may be used in a bed sheet attachment system is described. FIG. 1 shows a front perspective view of bed sheet system 20, which may comprise fitted sheet 30 and mattress pad 40, while FIG. 2 is a top view of fitted sheet 30 and mattress pad 40, and FIG. 3 is a bottom view of fitted sheet 30 when disposed over mattress 24.

Fitted sheet 30, which may comprise any conventional bed sheet material, has upper surface 32 and lower surface 37. Fitted sheet 30 further has upper side 33, lower side 35, front side 36, and rear side 34, which generally are disposed between upper and lower surfaces 32 and 37, as shown in FIGS. 1-3.

Figure 16:
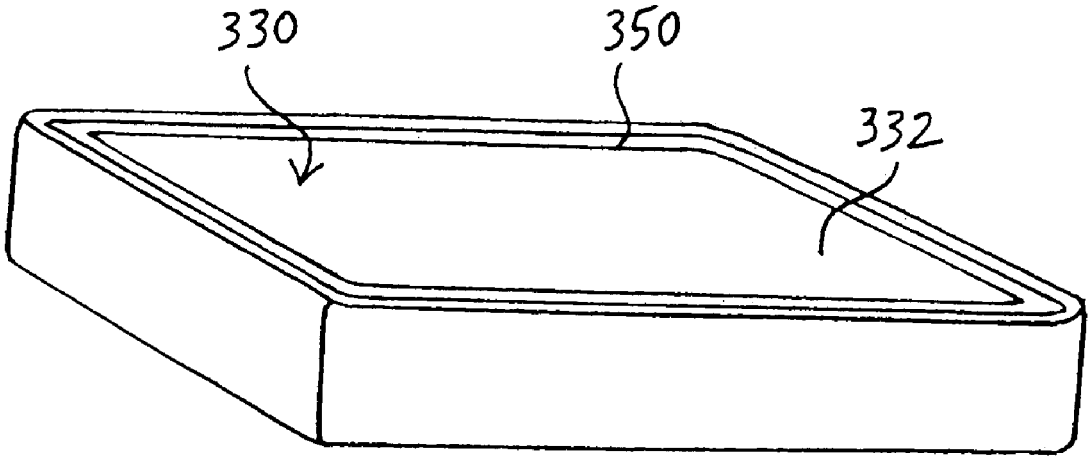
FIG. 16 is an alternative embodiment of a fitted sheet.

Mattress pad 40 may be disposed on a central region of upper surface 32 of fitted sheet 30. The outer regions 42 of mattress pad 40 may be attached to fitted sheet 30, for example, by sewing. Alternatively, an adhesive, heat bond or other means may be used to attach mattress pad 40 to fitted sheet 30. Mattress pad 40 may generally comprise any material that is comfortable for a user, such as a quilted pad of material. The positioning of mattress pad 40 on fitted sheet 30 may be such that mattress pad 40 is substantially aligned with the position in which a user would be most likely to sit, rest or sleep, thereby providing a comfortable surface to a user, as explained in further detail below. However, in an alternative embodiment, mattress pad 40 may be omitted, i.e., not coupled to the fitted sheet, as depicted in FIG. 16 below.

Fitted sheet 30 may be sized to fit any bed size available, including but not limited to twin, twin XL, double, queen and king-sized beds. It also may be sized for use in conjunction with any baby crib. The fitted sheet also may be configured for use in beds located in hospitals, hotels, schools, and any other private or public setting.

Regardless of bed size, upper side 33, lower side 35, front side 36, and rear side 34 are adapted to be disposed over side surfaces of mattress 24, as shown in FIG. 3. At this time, upper and lower surfaces 32 and 37 of fitted sheet 30 are disposed over upper and lower surfaces of mattress 24, respectively.

In one embodiment, if it is desired to adjust the tautness of fitted sheet 30 with respect to mattress 24, drawstring 62 may be provided. Drawstring 62 may comprise elastic characteristics to facilitate sealing of lower surface 37 of fitted sheet 30 around the lower surface of mattress 24. The perimeter of fitted sheet 30 may comprise a channel 61, such that drawstring 62 may be substantially disposed within channel 61, as shown in FIG. 3. A portion of drawstring 62 may exit channel 61 and be disposed through adjusting member 64 to form drawstring loop 63. Adjusting member 64 may comprise an actuator 65, e.g., a spring-resisted button. When actuated by a user, actuator 65 permits adjustments of loop 63 to increase or decrease the tautness of fitted sheet 30 over mattress 24 via drawstring 62. In an alternative embodiment, however, drawstring 62 may be omitted and fitted sheet 30 may comprise one or more elastic bands adapted to secure fitted sheet 30 around mattress 24.

Referring still to FIGS. 1-2, upper surface 32 of fitted sheet 30 may comprise one or more attachment members that are adapted to be coupled to a quick-change sheet 70, as explained in further detail in FIGS. 4-6 below. In one embodiment, hook-and-loop fasteners, for example, sold under the trademark VELCRO®, may be employed. In general, when the hook portion is pressed against the loop portion, the hooks catch in the loops and hold the pieces together. In an alternative embodiment, other attachment members, such as parts that employ a snap-fit connection or a magnetic connection, may be used to couple fitted sheet 30 to quick-change sheet 70.

In FIGS. 1-2, ten separate attachment members 50-59 are illustratively disposed around the perimeter of upper surface 32 of fitted sheet 30. Attachment members 50-59 may comprise the hook portion of a hook-and-loop fastener system, e.g., VELCRO®. As will be explained in further detail below, attachment members 50-59 may be adapted to releasably mate with corresponding attachment members 80-89 of quick-change sheet 70, respectively.

While ten attachment members 50-59 are illustrated in FIGS. 1-2, it will be apparent that any number may be employed. Moreover, the sizes and shapes of the attachment members may be varied. For example, attachment members 53 and 59 may comprise longer lengths than the other attachment members, as shown in FIG. 2. As another example, while three relatively short attachment members 55-57 are illustratively disposed near lower side 35 of fitted sheet 30, one longer, continuous attachment member may be employed. Further, one continuous attachment member may extend around all four sides of the upper surface of the fitted sheet, as depicted in FIG. 16 below. In short, numerous combinations are possible.

Attachment members 50-59 preferably are disposed around the perimeter of upper surface 32 of fitted sheet 30 at locations spaced apart from outer regions 42 of mattress pad 40, as depicted in FIGS. 1-2. Therefore, when a user sits or sleeps on the bed, the user's body may be disposed primarily over mattress pad 40, but is not expected to substantially overlay or contact attachment members 50-59, as explained in further detail below.

Figure 4:
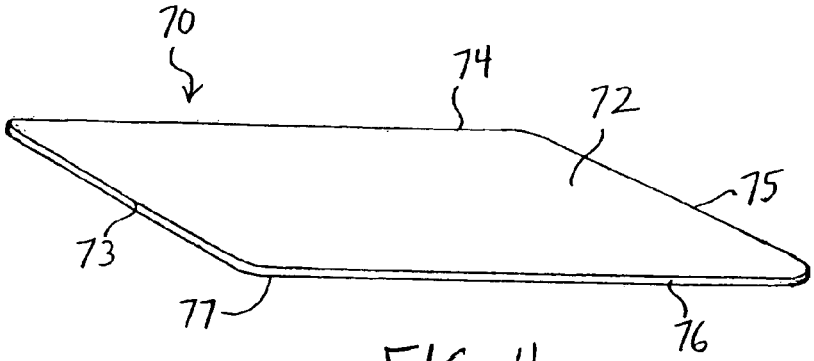
FIG. 4 is a perspective view of a top surface of a quick-change sheet that may be used in conjunction with the fitted sheet and mattress pad of FIGS. 1-3.
Figure 5:
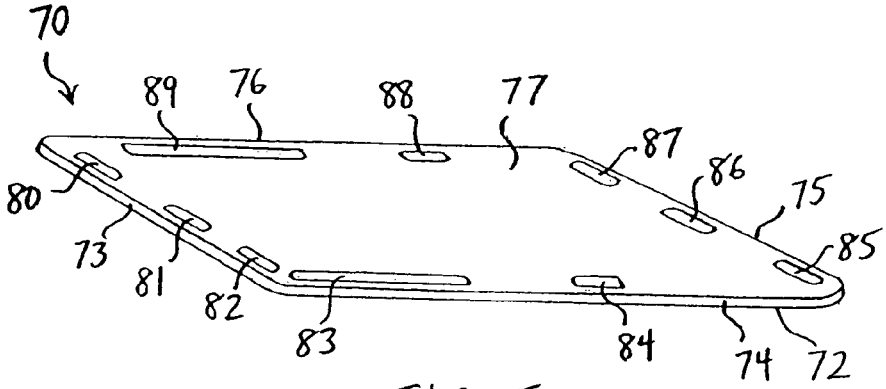
FIG. 5 is a perspective view of a bottom surface of the quick-change sheet of FIG. 4.

Referring now to FIGS. 4-5, a quick-change sheet 70, which may be used in conjunction with bed sheet system 20, is described. FIG. 4 illustrates the top surface and FIG. 5 illustrates the bottom surface of the quick-change sheet 70. Quick-change sheet 70 has upper surface 72 and lower surface 77. Upper and lower surfaces 72 and 77 are separated by upper end 73, lower end 75, front end 76, and rear end 74, as shown in FIGS. 4-5. Upper surface 72 preferably is substantially smooth, while lower surface 77 comprises a plurality of attachment members 80-89, which are adapted to releasably mate with attachment members 50-59 of fitted sheet 30, respectively.

Figure 6:
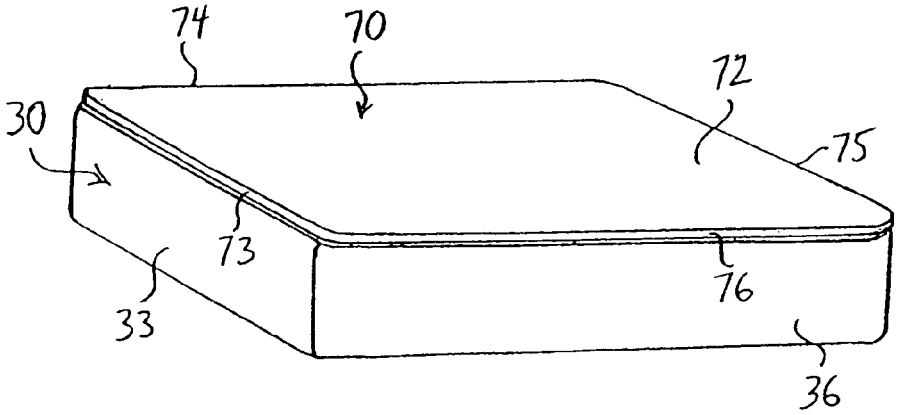
FIG. 6 is a front perspective view illustrating the quick-change sheet of FIGS. 4-5 disposed over the fitted sheet and mattress pad of FIGS. 1-3.

Referring to FIG. 6, the coupling of quick-change sheet 70 to fitted sheet 30 is shown. Quick-change sheet 70 may be aligned with fitted sheet 30 such that attachment members

80-89 are substantially aligned with their respective attachment members 50-59 of fitted sheet 30. The sheets may be pressed together to securely attach quick-change sheet 70 to fitted sheet 30 at the attachment locations. When the attachment members are secured, upper end 73, lower end 75, front end 76, and rear end 74 of quick-change sheet 70 may remain disposed substantially over upper surface 32 of fitted sheet 30, i.e., the ends 73-76 do not extend substantially over upper side 33, lower side 35, front side 36, and rear side 34, as depicted in FIG. 6.

Advantageously, by employing a quick-change sheet 70 in conjunction with fitted sheet 30, a user does not need to tuck-in quick-change sheet 70 around or over the corners of the bed. If quick-change sheet 70 becomes dirty or soiled, a user may simply detach quick-change sheet 70 from engagement with fitted sheet 30 and re-attach a different, cleaner quick-change sheet 70. The elimination of the need to tuck-in quick-change sheet 70 may be especially useful in situations where it may be difficult to tuck in a sheet, for example, in a baby crib, in a dorm room where a bed may be pressed against a wall, and so forth. Moreover, since quick-change sheet 70 is directly in contact with a user, while fitted sheet 30 is substantially separated from a user, fitted sheet 30 may be changed less frequently than quick-change sheet 70.

Further, as noted above, when quick-change sheet 70 is disposed over fitted sheet 30, a comfortable surface may be provided to the user. More specifically, when the user rests on quick-change sheet 70, the user may be substantially aligned with mattress pad 40, e.g., a quilted pad. The user does not substantially contact attachment members 50-59 and 80-89 of fitted sheet 30 and quick-change sheet 70, respectively.

Quick-change sheet 70 may comprise a conventional bed sheet fabric, or alternatively, may feature a special layer such as lamb's wool. Optionally, upper surface 72 and/or lower surface 77 may comprise a design, such as a college logo, sports team logo, seasonal design, heart-shaped design, a customized digital logo, or the like. Moreover, multiple quick-change sheets 70 may be sold in sets to users, thereby facilitating the exchange of quick-change sheets 70 in a fast and efficient manner.

As will be apparent, any free-standing top sheet, comforter, quilt, blanket or other covering may be disposed partially or completely over quick-change sheet 70 after it is attached to fitted sheet 30, as shown in FIG. 6. Alternatively, quick-change sheet 70 may be releasably or permanently attached to a portion of a top sheet, for example, as described in FIGS. 12-13 below.

In one embodiment, quick-change sheet 70 may comprise a moisture-absorbing material. The moisture-absorbing material may be particularly useful when quick-change sheet 70 is used in conjunction with babies, elderly persons, menopausal women who may have frequent night sweats, college students, patients at hospitals, and so forth. The moisture-absorbing material may be integral to quick-change sheet 70, i.e., formed in the material itself, or alternatively, one or more separate and distinct moisture-absorbing members may be disposed on at least a portion of quick-change sheet 70.

Further, while quick-change sheet 70 has been described with respect to being coupled to fitted sheet 30 covering a bed, a similar quick-change sheet 70 also may be used on other surfaces, for example, a pillowcase. In such an embodiment, the quick-change sheet may releasably mate with a complementary surface of the pillowcase. If the quick-change sheet disposed on pillowcase becomes soiled, then it may be removed for cleaning and another quick-change sheet may be attached.

Further, a similar quick-change sheet 70 also may be used as part of a pet bed. In such an embodiment, the quick-change sheet may releasably mate with a complementary surface of a bed designed to accommodate numerous type of pets, such as dogs and cats. In such an embodiment, the quick-change sheet disposed on the pet bed may comprise a moisture-absorbing material, as noted above.

Figure 7:
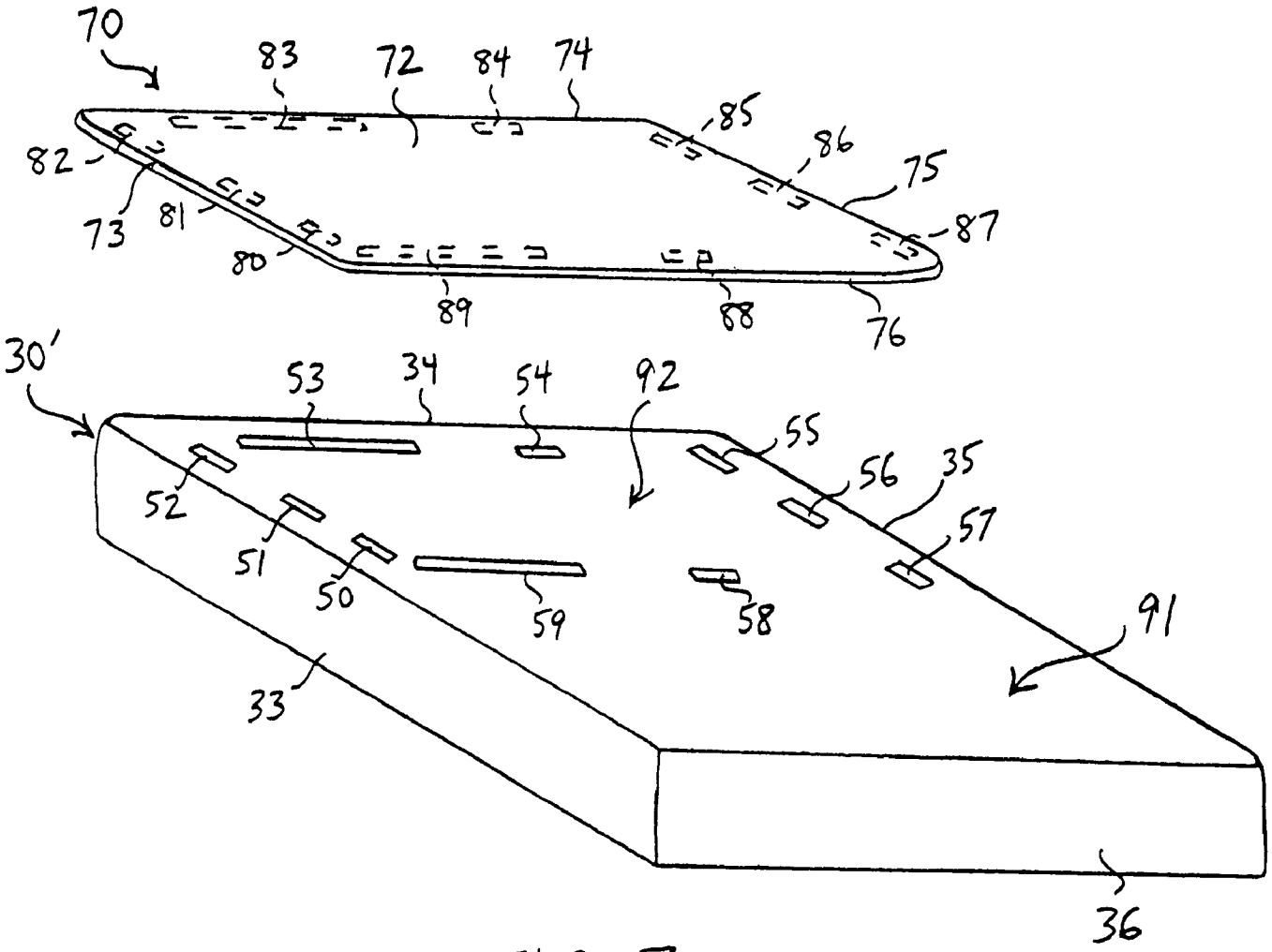
FIG. 7 is a front perspective view of an alternative fitted sheet that may be used in conjunction with a quick-change sheet.

Referring now to FIG. 7, in an alternative embodiment, quick-change sheet 70 may be adapted to be disposed only over a portion of a fitted sheet. For example, alternative fitted sheet 30' may comprise attachment members 50-59 disposed only on rear portion 92 of the fitted sheet. When attachment members 80-89 quick-change sheet 70 are coupled to attachment members 50-59, respectively, quick-change sheet 70 covers only rear portion 92 of fitted sheet 30'. When in use, one user may sleep substantially over quick-change sheet 70 on rear portion 92, while another user may sleep substantially over front portion 91, i.e., directly on fitted sheet 30'. In this embodiment, if quick-change sheet 70 becomes soiled or otherwise needs to be changed, the user on rear portion 92 may remove and replace quick-change sheet 70 with another sheet, without substantially interfering with the other user situated on front portion 91.

While quick-change sheet 70 is illustratively disposed over rear portion 92 in the embodiment of FIG. 7, it will be apparent that quick-change sheet 70 alternatively may be disposed over front portion 91. Further, front portion 91 may comprise an additional set of attachment members that are configured to releasably mate with another quick-change sheet, such that when the bed is fully assembled, there may be multiple quick-change sheets covering multiple portions of the bed.

Figure 8:
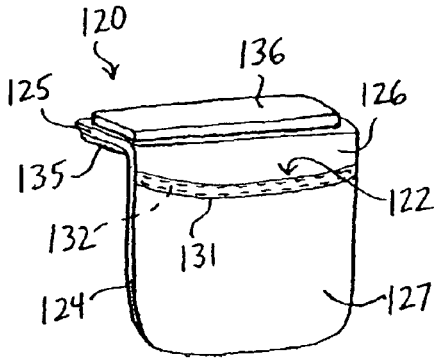
FIG. 8 is a front perspective view of a pocket member that may be used in conjunction with a bed sheet system.
Figure 9:
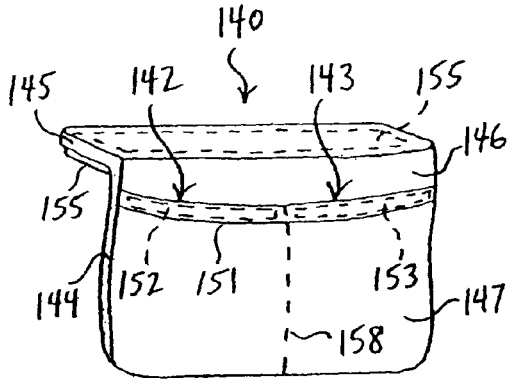
FIG. 9 is a front perspective view of an alternative embodiment of the pocket member of FIG. 8.

Referring now to FIGS. 8-11, an additional feature of bed sheet system 20 is described. FIGS. 8-9 illustrate pocket members 120 and 140, respectively, which may be used in conjunction with fitted sheet 30 and/or quick-change sheet 70 to provide a convenient storage area in close proximity to the bed.

In FIG. 8, pocket member 120 comprises pocket 122, which may be formed between a portion of inner layer 126 and outer layer 127. An elastic member 132 may be disposed in upper channel 131 of outer layer 127, thereby providing an elastic closure capability for pocket 122. In a preferred embodiment, inner and outer layers 126 and 127 may each comprise a layer of fabric, but alternatively, may comprise any suitable material such as plastic.

Inner layer 126 may comprise a generally upright portion 124 and an attachment portion 125, which may be formed integral with, or coupled to, upright portion 124. Attachment portion 125 preferably is adapted to be bent at an angle with respect to upright portion 124, and more preferably, at an angle of between about 70 and 110 degrees, as depicted in FIG. 8.

Pocket member 120 may employ one or more attachment members disposed above and/or below attachment portion 125. In a preferred embodiment, a first attachment member 135 may be disposed on a lower surface of attachment portion 124 and may comprise a loop portion of a hook-and-loop fastener system, e.g., VELCRO®. Optionally, a second attachment member 136 may be disposed on an upper surface of attachment portion 125 and may comprise a hook portion of a hook-and-loop fastener system, for purposes described below.

In an alternative embodiment, the design of pocket member 120 may be varied to have multiple configurations, such as different shapes and sizes. For example, as shown in FIG. 9, alternative pocket member 140 comprises first pocket 142 and second pocket 143 formed between a portion of inner layer 146 and outer layer 147. Inner layer 146 may comprise a generally upright portion 144 and an attachment portion 145. Unlike pocket member 120, pocket member 140 may comprise a divider 158, which is adapted to separate first pocket 142 from second pocket 143, as shown in FIG. 9. Divider 158 may comprise a substantially longitudinal sew, or alternatively, an adhesive, clip or other member configured to provide a barrier between first and second pockets 142 and 143. Elastic members 152 and 153 may be disposed in upper channel 151 of outer layer 147 and may be configured to provide an elastic closure capability for first and second pockets 142 and 143, respectively.

Like pocket member 120, alternative pocket member 140 may comprise one or more attachment members disposed above and/or beneath attachment portion 145. As shown in FIG. 9, a first attachment member 155 is disposed beneath attachment portion 145, although greater of fewer attachment members may be provided.

Figure 10:
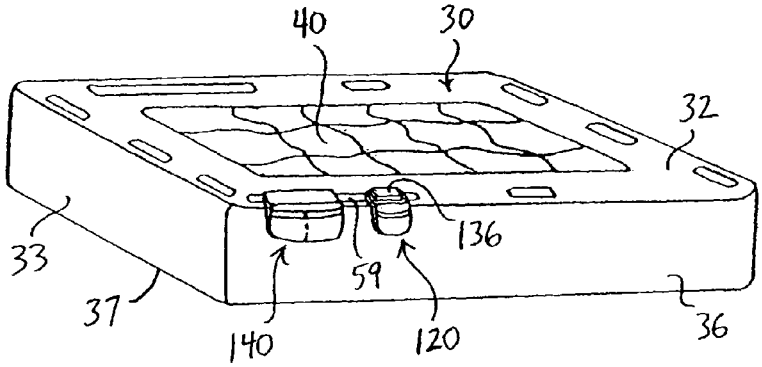
FIG. 10 is a front perspective view illustrating the pocket members of FIGS. 8-9 attached to a fitted sheet.
Figure 11:
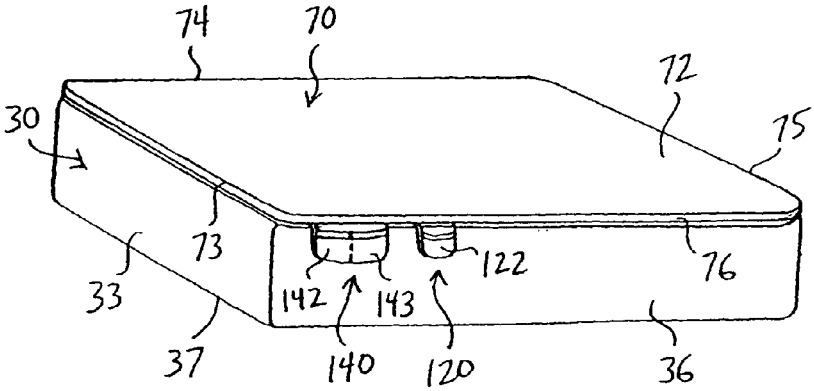
FIG. 11 is a front perspective view illustrating the pocket members of FIGS. 8-9 attached to a fitted sheet with a quick-change sheet disposed over the fitted sheet.

Referring now to FIGS. 10-11, pocket members 120 and 140 are shown in use with fitted sheet 30. First attachment member 135 of pocket member 120 preferably is adapted to releasably engage any of attachment members 50-59 of fitted sheet 30. Similarly, attachment member 155 of pocket member 140 preferably is adapted to releasably engage any of the attachment members 50-59. In the embodiment shown, attachment members 135 and 155 of pocket members 120 and 140, respectively, are each coupled to attachment member 59 of fitted sheet 30, as depicted in FIG. 10. Preferably, attachment members 135 and 155 releasably mate with attachment member 59, e.g., using a hook-and-loop fastener system, as described above. As will be apparent, only one pocket member 120 or 140 may be employed. Alternatively, pocket members 120 and 140 may be coupled to different attachment members 50-59. Further, greater than two pocket members may be employed.

In the embodiment of FIGS. 10-11, when attachment members 135 and 155 are releasably attached to attachment member 59 of fitted sheet 30, pockets 122, 142 and 143 preferably substantially hang over front side 36 of fitted sheet 30. When quick-change sheet 70 is coupled to upper surface 32 of fitted sheet 30, as shown in FIG. 11, pockets 122, 142 and 143 preferably remain substantially exposed and readily accessible to a user. It should be noted that, if second attachment member 136 is disposed on an upper surface of attachment portion 125, it may releasably engage attachment member 89 of quick-change sheet 70, thereby providing a secure attachment between the pocket member and the quick-change sheet.

Advantageously, by using pocket members 120 and/or 140 of FIGS. 8-11, a user may store a cell phone, toiletries, or virtually anything else that fits in or extends from pockets 122, 142 and 143, at a location in extremely close proximity to the user when the user is on the bed. Moreover, as noted above, any number of pocket members may be employed, and a user may increase or decrease the number of pocket members, and their positioning, at virtually any time. Further, the depth and configurations of the pocket members may be varied, for example, the pocket members may hang partly over front side 36 of fitted sheet 30, as depicted in FIGS. 10-11, or may extend further down towards lower surface 37 or below. Pocket members having varying depths may be useful for holding separate items, for example, a shallower pocket member may be suitable for holding a cell phone, while a deeper pocket member may be suitable for holding a toothbrush. Finally, if a top sheet, comforter or other covering is used in conjunction with the bedding system, such coverings may extend over the pocket members, i.e., the pocket members may remain exposed to the user or may become covered.

Figure 12:
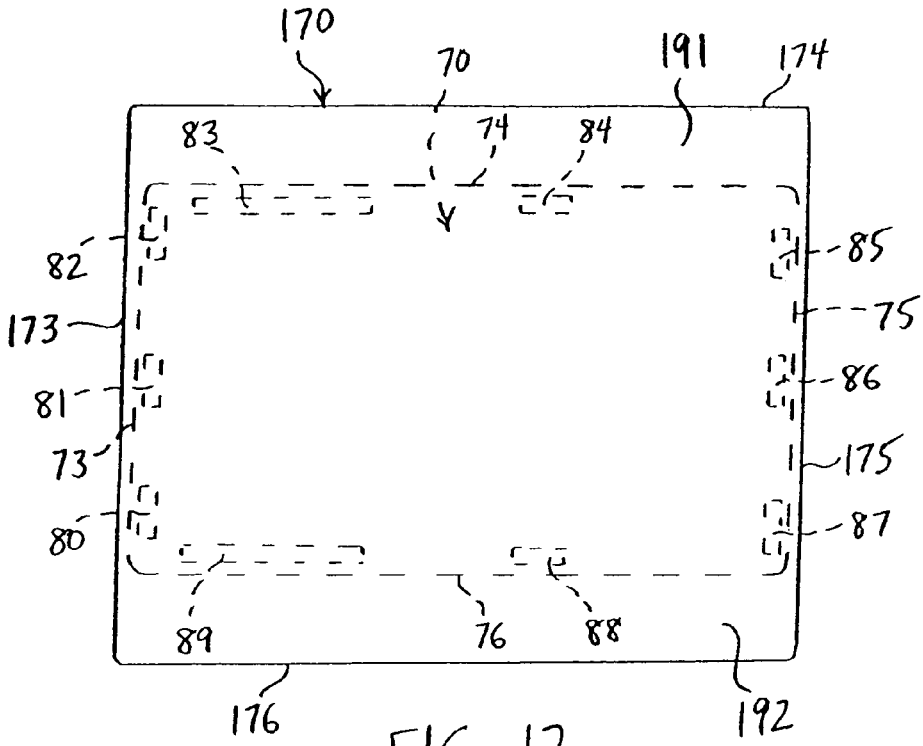
FIG. 12 is a top view illustrating a top sheet attached to a lower end of a quick-change sheet.
Figure 13:
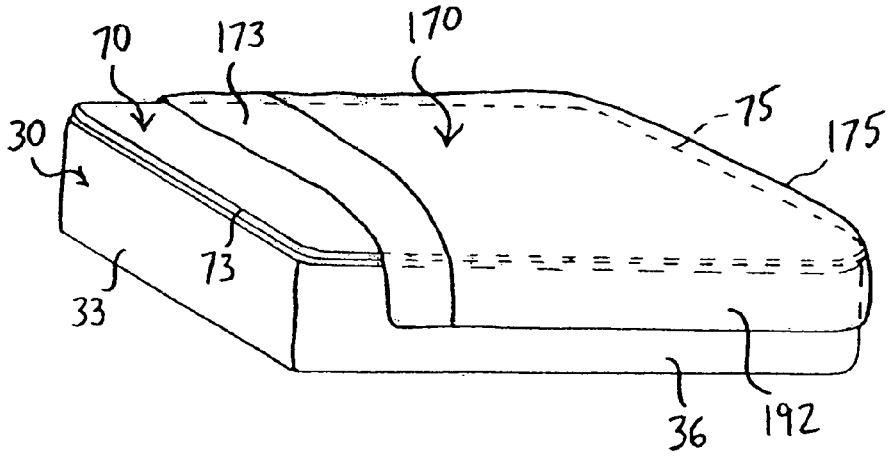
FIG. 13 is a front perspective view illustrating the top sheet and quick-change sheet of FIG. 12 disposed over a fitted sheet.

Referring now to FIGS. 12-13, in an alternative embodiment, at least a portion of quick-change sheet 70 may be attached to a top sheet 170. Preferably, a portion of lower end 75 of quick-change sheet 70 is attached to a portion of lower end 175 of top sheet 170. When attached, front end 176 of top sheet 170 may extend beyond the confines of front end 76 of quick-change sheet 70 at front overlap region 192, as shown in FIG. 12. Similarly, rear end 174 may extend beyond the confines of rear end 74 of quick-change sheet 70 at rear overlap region 191.

A portion of lower end 75 of quick-change sheet 70 may be permanently attached to a portion of lower end 175 of top sheet 170 by sewing the two sheets together. Alternatively, the lower end 75 of quick-change sheet 70 may be releasably attached to lower end 175 of top sheet 170, e.g., using a zipper engagement, mating VELCRO® strips, and so forth.

In use, quick-change sheet 70 may be attached to fitted sheet 30 in the manner described above, e.g., by attaching the respective attachment members 50-59 and 80-89. Subsequently, upper end 173 of top sheet 170 may be pulled towards upper end 73 of quick-change sheet 70 to make the bed. As shown in FIG. 13, upper end 173 of top sheet 170 may be folded over itself, or rolled down with respect to upper end 73 of fitted sheet 70. At this time, front overlap region 192 of top sheet 170 may extend partially over front side 36 of fitted sheet 30, as depicted in FIG. 13, and rear overlap region 191 similarly may extend partially over rear side 34 of fitted sheet 30.

Figure 14:
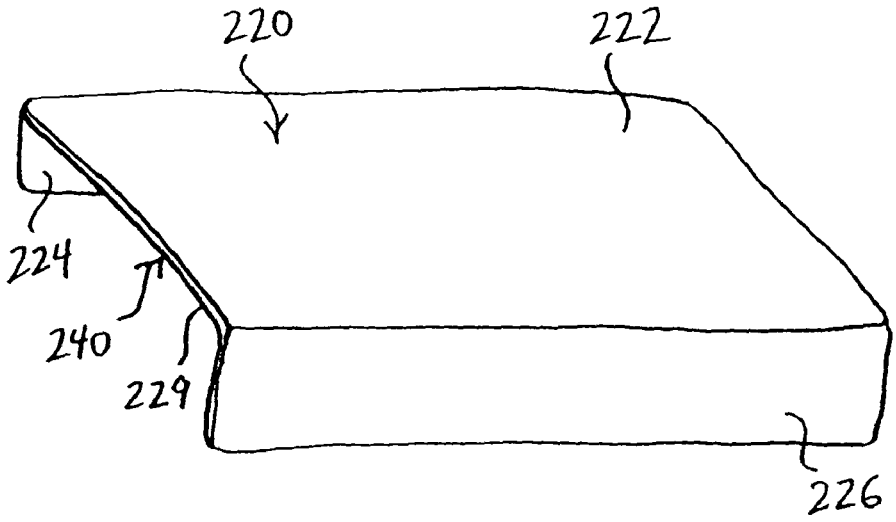
FIG. 14 is a front perspective view of a comforter having an inner liner, which may be used in conjunction with the apparatus of FIGS. 1-13.
Figure 15:
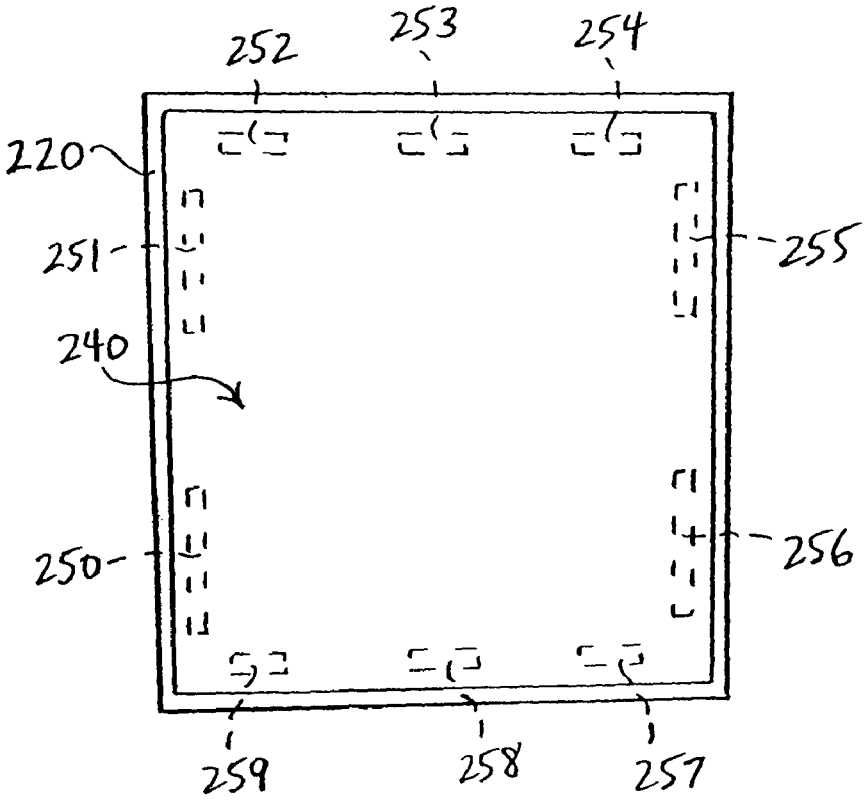
FIG. 15 is a bottom view of the comforter of FIG. 14.

Referring now to FIGS. 14-15, a comforter that may be used in conjunction with any of the bed systems described above is shown. As illustrated in FIG. 14, comforter 220 comprises upper surface 222, lower surface 229, front surface 226, and rear surface 224. The dimensions of comforter 220 may be sized such that the comforter may be placed over a bed of any size, whereby the front and rear surfaces 226 and 224 lay over the front and rear surfaces of the bed, respectively.

Lining 240 may be attached to lower surface 229 of comforter 220, for example, at one or more removable attachment locations 250-259. A hook-and-loop fastening system, such as mating VELCRO® strips, may be employed at attachment locations 250-259. In a preferred embodiment, lining 240 comprises a fleece layer, such that during use, the fleece layer is disposed in proximity to the user. By providing a releasable, mating attachment between lining 240 and comforter 220, lining 240 may be removed as needed, for example, for cleaning or to remove a layer due to temperature conditions.

Referring now to FIG. 16, an alternative embodiment of a fitted sheet is described. Fitted sheet 330 comprises one continuous attachment member 350, which extends around all four sides of upper surface 332 of fitted sheet 330, as depicted in FIG. 16. Such a configuration may facilitate attachment of quick-change sheet 70 of FIGS. 4-5, because the one or more attachment members 80-89 of quick-change sheet 70 need not be precisely aligned with individual corresponding attachment members disposed on fitted sheet 330. Moreover, the mattress pad 40 of FIGS. 1-2 is omitted in the embodiment of FIG. 16. However, as noted above, the mattress pad may be employed and/or the attachment member 350 may comprise one uniform member or multiple spaced apart members.

While various embodiments of the invention have been described, it will be apparent to those of ordinary skill in the art that many more embodiments and implementations are possible within the scope of the invention. Accordingly, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. A bed sheet system, comprising:

a fitted sheet adapted to be coupled to a mattress and cover at least an entire upper surface of the mattress, the fitted sheet having an upper surface and at least one side surface, wherein the upper surface of the fitted sheet faces upward when the fitted sheet is coupled to the mattress;

at least one attachment member disposed on the upper surface of the fitted sheet;

a quick-change sheet having upper and lower surfaces, wherein the upper surface may be exposed to a user;

at least one attachment member disposed on the lower surface of the quick-change sheet, wherein the attachment member of the quick-change sheet is configured to releasably mate with the attachment member of the fitted sheet, wherein, when mated, a space formed between the upper surface of the fitted sheet and the lower surface of the quick-change sheet is generally inaccessible to a user; and at least one pocket member adapted to be coupled to the attachment member disposed on the fitted sheet, wherein at least one of the attachment members of the fitted sheet is configured to be simultaneously attached to each of at least a portion of the quick-change sheet and at least a portion of the pocket member.

2. The bed sheet system of claim 1 further comprising a mattress pad adapted to be disposed on the upper surface of the fitted sheet, wherein the attachment members of the fitted sheet are disposed on the fitted sheet at one or more locations spaced apart from the mattress pad.

3. The bed sheet system of claim 1 wherein at least a portion of the quick-change sheet is attached directly to a top sheet, such that when the quick-change sheet is coupled to the fitted sheet, the top sheet may be disposed substantially over the upper surface of the quick-change sheet.

4. The bed sheet system of claim 3 wherein a lower end of the quick-change sheet is attached directly to a lower end of the top sheet.

5. The bed sheet system of claim 1 wherein a portion of the pocket member is adapted to be disposed over a side surface of the fitted sheet, such that when the quick-change sheet is coupled to the fitted sheet, the portion of the pocket member is exposed to a user.

6. The bed sheet system of claim 5, wherein the pocket member comprises an attachment portion, and wherein a lower surface of the attachment portion comprises a first attachment member adapted to mate with the attachment member of the fitted sheet.

7. The bed sheet system of claim 6, wherein an upper surface of the attachment portion comprises a second attachment member adapted to mate with the attachment member of the quick-change sheet.

8. The bed sheet system of claim 1 wherein the pocket member comprises two distinct pockets separated by a longitudinal sew.

9. The bed sheet system of claim 1 wherein the quick-change sheet is adapted to overlay only a portion of the upper surface of the fitted sheet, such that a substantial remaining portion of the upper surface of the fitted sheet is not covered by the quick-change sheet.

10. The bed sheet system of claim 1 wherein the attachment member of the quick-change sheet is coupled to the attachment member of the fitted sheet using a hook-and-loop fastening system.

11. The bed sheet system of claim 1 wherein the quick-change sheet comprises a moisture-absorbing material.

12. A method of assembling one or more components of a bed, the method comprising:

providing a fitted sheet adapted to be coupled to a mattress and cover at least an entire upper surface of the mattress, the fitted sheet having an upper surface and at least one side surface, wherein the upper surface of the fitted sheet faces upward when the fitted sheet is coupled to the mattress, wherein the fitted sheet comprises at least one attachment member disposed on the upper surface of the fitted sheet;

providing a quick-change sheet having upper and lower surfaces, wherein at least one attachment member is disposed on the lower surface of the quick-change sheet; and releasably coupling the attachment member of the fitted sheet to the attachment member of the quick-change sheet, such that the upper surface of the quick-change sheet is substantially exposed to a user, wherein, when mated, a space formed between the upper surface of the fitted sheet and the lower surface of the quick-change sheet is generally inaccessible to a user; and providing at least one pocket member adapted to be coupled to the attachment member disposed on the fitted sheet, wherein at least one of the attachment members of the fitted sheet is configured to be simultaneously attached to each of at least a portion of the quick-change sheet and at least a portion of the pocket member.

13. The method of claim 12 further comprising:

providing a mattress pad disposed on the upper surface of the fitted sheet; and positioning the attachment members of the fitted sheet on the upper surface of the fitted sheet at one or more locations spaced apart from the mattress pad.

14. The method of claim 12 further comprising attaching at least a portion of the quick-change sheet directly to a top sheet, such that when the quick-change sheet is coupled to the fitted sheet, the top sheet may be disposed substantially over the upper surface of the quick-change sheet.

15. The method of claim 12, wherein the pocket member comprises an upright portion and an attachment portion, the method further comprising:

coupling a first attachment member disposed on a lower surface of the attachment portion to the attachment member on the fitted sheet; and coupling a second attachment member disposed on an upper surface of the attachment portion to the attachment member on the quick-change sheet.

16. The method of claim 12 further comprising covering only a portion of the upper surface of the fitted sheet with the quick-change sheet, such that a substantial remaining portion of the upper surface of the fitted sheet is not covered by the quick-change sheet.

17. The method of claim 12 further comprising coupling the attachment member of the quick-change sheet to the attachment member of the fitted sheet using a hook-and-loop fastening system.

18. A bed sheet system, comprising:

a fitted sheet adapted to be coupled to a mattress, wherein the fitted sheet comprises an upper surface and at least one side surface, wherein the upper surface faces upward when coupled to the mattress;

at least one attachment member disposed on the upper surface of the fitted sheet;

a quick-change sheet configured to releasably mate with at least one of the attachment members of the fitted sheet; and at least one pocket member comprising at least one attachment member that releasably mates with at least one of the attachment members of the fitted sheet, wherein a portion of the pocket member is adapted to be disposed over the side surface of the fitted sheet, such that when the quick-change sheet is coupled to the fitted sheet, the portion of the pocket member is exposed to a user, and wherein at least one of the attachment members of the fitted sheet is configured to be simultaneously attached to each of at least a portion of the quick-change sheet and at least a portion of the pocket member.

19. The bed sheet system of claim 18 further comprising a mattress pad adapted to be disposed on the upper surface of the fitted sheet, wherein the attachment members of the fitted sheet are disposed on the fitted sheet at one or more locations spaced apart from the mattress pad.

20. The bed sheet system of claim 18 wherein at least a portion of the quick-change sheet is attached directly to a top sheet, such that when the quick-change sheet is coupled to the fitted sheet, the top sheet may be disposed substantially over the upper surface of the quick-change sheet.

21. The bed sheet system of claim 18, wherein the pocket member comprises an upright portion and an attachment portion, wherein a lower surface of the attachment portion comprises a first attachment member adapted to mate with at least one of the attachment members of the fitted sheet, and wherein an upper surface of the attachment portion comprises a second attachment member adapted to mate with an attachment member of the quick-change sheet.

22. The bed sheet system of claim 18 wherein the quick-change sheet is adapted to overlay only a portion of the upper surface of the fitted sheet, such that a substantial remaining portion of the upper surface of the fitted sheet is not covered by the quick-change sheet.

23. The bed sheet system of claim 18 wherein the pocket member extends laterally across only a portion of a width of the upper surface of the fitted sheet.

* * * * *